US005893186A

United States Patent [19]

Issler et al.

[11] Patent Number: 5,893,186

[45] Date of Patent: Apr. 13, 1999

[54] METHOD FOR CONSTRUCTION OF FOOTWEAR

[75] Inventors: James E. Issler, Greenwich, Conn.; Thomas E. McClaskie, Bethlehem, Pa.

[73] Assignee: Columbia Insurance Company, Omaha, Nebr.

[21] Appl. No.: 08/782,443

[22] Filed: Jan. 17, 1997

[51] Int. Cl.[6] ..... A43B 23/00; A43D 25/00

[52] U.S. Cl. ..... 12/146 C; 36/46.5; 12/145 R

[58] Field of Search ..... 36/102, 145, 55, 36/46.5, 10, 12, 76 C, 43; 12/145, 147 R, 146 C

[56] References Cited

U.S. PATENT DOCUMENTS

| | | | |
|---|---|---|---|
| 2,746,177 | 5/1956 | Maccarone | 36/46.5 X |
| 2,963,722 | 12/1960 | Stix | 12/145 |
| 3,348,251 | 10/1967 | Appleton et al. | 12/147 R |
| 3,555,705 | 1/1971 | Eder et al. | 12/145 X |
| 3,705,463 | 12/1972 | Lown | 36/46.5 X |
| 3,784,053 | 1/1974 | Stout . | |
| 4,146,129 | 3/1979 | Wood . | |
| 4,171,046 | 10/1979 | Bonczyk . | |
| 4,240,545 | 12/1980 | Stout . | |
| 4,253,564 | 3/1981 | Engdahl, Jr. . | |
| 4,286,709 | 9/1981 | Manizza . | |
| 4,349,103 | 9/1982 | Wood . | |
| 4,430,767 | 2/1984 | Allard | 36/76 C X |
| 4,662,018 | 5/1987 | Autry | 36/12 X |
| 4,704,808 | 11/1987 | Bianchini et al. | 36/43 X |
| 4,927,009 | 5/1990 | Stout . | |
| 4,989,779 | 2/1991 | Lashyro . | |
| 5,579,904 | 12/1996 | Holley, Jr. . | |
| 5,611,425 | 3/1997 | Holley, Jr. . | |

*Primary Examiner*—B. Dayoan
*Attorney, Agent, or Firm*—Fish & Richardson P.C.

[57] ABSTRACT

A method for construction of footwear includes providing an upper defining a volume for receiving a wearer's foot, the upper having a peripheral lasting edge; sewing an inner liner to an inner surface of the upper; sewing a front bottom lining to a peripheral edge of a front portion only of the inner liner; lasting, along an edge of a last, the peripheral lasting edge portion of the upper over an insole tuck and front bottom lining, the insole tuck being temporarily secured to the last; and securing the outsole to the lasted upper. This dual-approach construction method combines the advantages of increased comfort at the front portion of the wearer's foot with attractiveness and good support at the rearward portion of a shoe.

10 Claims, 3 Drawing Sheets

METHOD FOR CONSTRUCTION OF FOOTWEAR

BACKGROUND OF THE INVENTION

The invention relates to footwear.

There are a wide variety of shoe constructions. In one construction method, popular for making athletic shoes (e.g., lightweight running or jogging shoes), a relatively thin layer of lightweight material is sewed along the bottom edge of an upper. This construction method is sometimes referred to as a Stroebel construction because a Stroebel stitching machine can be used to sew the lightweight material to the inner liner. However, the Stroebel construction method is not used in constructing dress shoes, particularly those with dress heels, in which the heel is attached by fasteners (e.g., nails, rivets, screws) from the inside of the shoe.

SUMMARY OF THE INVENTION

In a general aspect of the invention, a method for construction of footwear includes providing an upper defining a volume for receiving a wearer's foot, the upper having a peripheral lasting edge; sewing an inner liner to an inner surface of the upper; sewing a front bottom lining to a peripheral edge of a front portion only of the inner liner; lasting, along an edge of a last, the peripheral lasting edge portion of the upper over an insole tuck and front bottom lining, the insole tuck being temporarily secured to the last; and securing the outsole over the lasted upper. Note that the term "sewing" as used herein is intended to include not only stitching (e.g., stroebel stitching) but seaming.

With this hybrid construction approach, the forward and rearward portions of the upper are attached to the outsole using different methods. The forward portion of the shoe includes the front lining bottom which is formed of a relatively thin and sturdy material and serves to hold the front portion of the inner liner together and provides a surface for a subsequently performed lasting operation. The front bottom lining also eliminates the need for a "full" insole which is much more rigid than the front bottom lining. Thus, the front bottom lining provides a relatively lightweight, flexible feel to the wearer during walking.

On the other hand, the rearward portion generally requires more structural rigidity to absorb forces received by the shoe and wearer's foot during walking. Thus, the rearward portion of the shoe includes the insole tuck which is thicker and substantially more rigid than the front lining bottom. The insole tuck also typically supports the wearer's foot, as well as a heel which is typically attached to the outsole. Moreover, lasting the upper over the front lining bottom and insole tuck provides a tight, sleek appearance to the shoe since there are no surfaces along the periphery of the outsole required for sewing or stitching the components of the shoe together.

Thus, this dual-approach construction method combines the advantages of increased comfort at the front portion of the wearer's foot with attractiveness and good support at the rearward portion of a shoe.

In embodiments of the invention, the method may include one or any of the following additional steps. The front bottom lining and insole tuck layers have thicknesses in a range between 0.2 mm and 0.5 mm and a range between 2 mm and 6 mm, respectively. The front bottom lining is formed of a non-stretchable, typically non-woven material. A rigid reinforcement shank is inserted within the insole tuck. A heel is attached to the outsole A sock liner is inserted within the volume of the upper.

Other advantages and features of the invention will be apparent from the following description of presently preferred embodiments, and from the claims.

DESCRIPTION OF THE PREFERRED EMBODIMENTS

Figure 1:
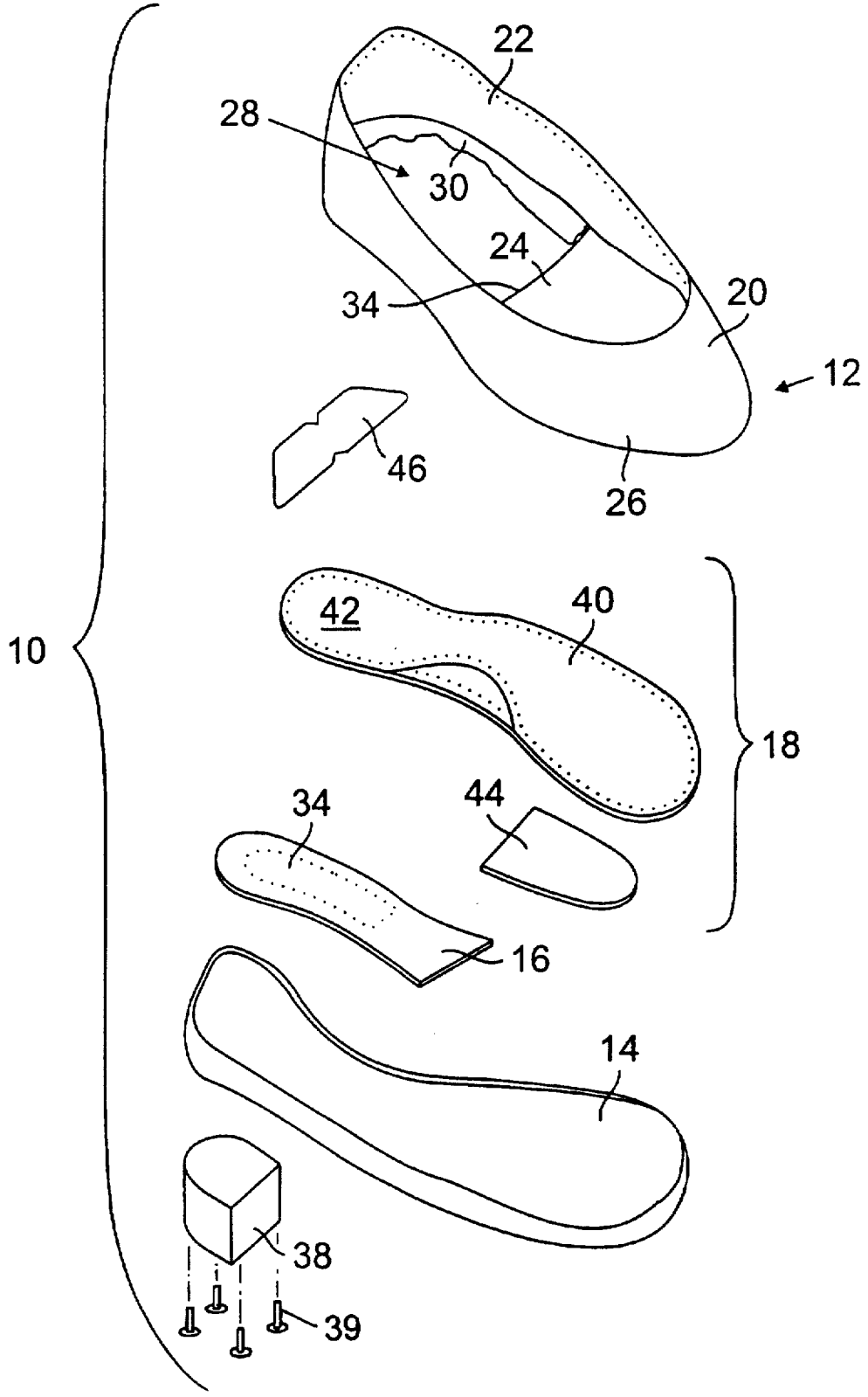
FIG. 1 is an exploded perspective view of the component parts of a shoe constructed in accordance with the invention.

Referring to FIG. 1, a shoe 10 includes a shoe upper assembly 12, an outsole 14, a tuck 16 and a sock liner 18.

Shoe upper assembly 12 includes an upper 20, typically made from leather including an inner liner 22 which is sewed to the inner surface of the upper and fabricated of materials (e.g., soft leather) selected to provide comfort to the wearer during walking.

Tuck 16 is formed of a rigid fiber material and includes a metal reinforcement shank 34 (shown in dashed lines) which is embedded within the tuck. Tuck 16 extends generally from the heel of the shoe over an edge 36 of a front bottom lining 24 (discussed below) to provide the structural rigidity to the rear portion of the shoe where it is most needed. Tuck 16 supports a heel 38 which is attached to outsole 14.

Sock liner 18 includes an inside layer 40 (shown in dashed lines) formed of a polyester material and covered by a top layer 42, e.g. of pigskin leather. In some embodiments, inside layer 40 may be decoratively quilted to provide an aesthetically pleasing look to the interior surface of the shoe.

The construction method of shoe 10 will now be described in conjunction with the figures.

In preparation for constructing shoe 10, a counter or back stiffener 46 (FIG. 1) is inserted into upper assembly 12 to provide structural support to the heel portion of shoe. Box toes or toe stiffeners (not shown) may also be inserted into the front portion of upper assembly 12 to provide support to the toe region of the shoe. These counters are generally formed of a thermoplastic material on a counter-forming machine using heating and cooling molds.

Figure 2:
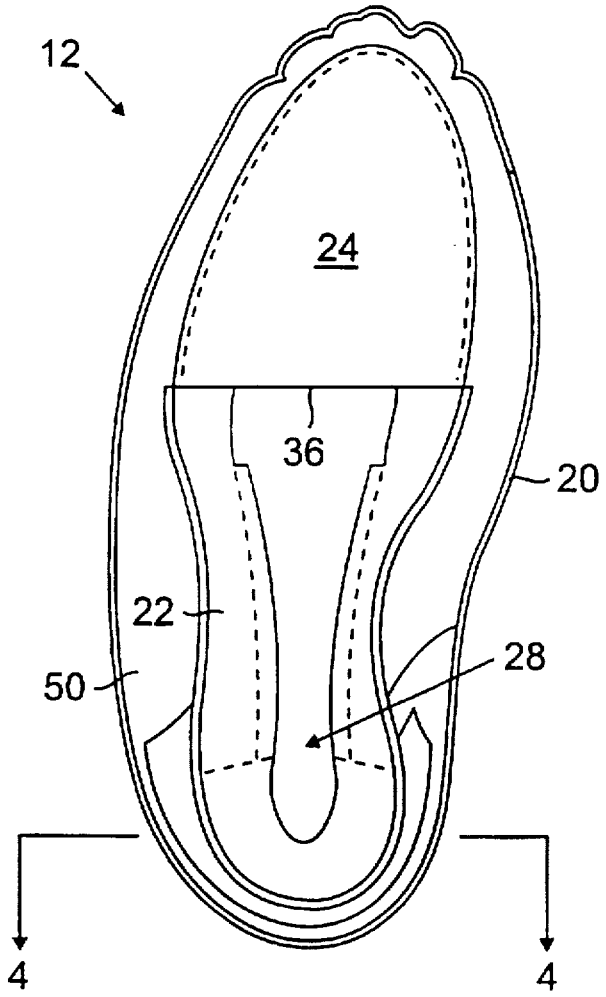
FIG. 2 is a bottom view of the shoe of FIG. 1, partially constructed showing a front bottom lining of the shoe sewed to an upper.

Referring to FIG. 2, a front bottom lining 24 is sewed to a front portion 26 of inner liner 22. Front bottom lining 24 extends from a toe region to a region forward of the shank region of the inner liner. Front bottom lining 24 is formed of a non-stretchable, sturdy material (e.g., non-woven fabric) and serves to hold the front portion of inner liner 24 together and provides a surface for a subsequently performed lasting operation which is described below. Front bottom lining also eliminates the need for a "full" insole which is much more rigid than the front bottom lining. At this stage of construction, upper assembly 12, shown free-floating in FIG. 1, has an open rear portion 28 with the front portion 26 of inner liner 22 and front bottom lining 24 forming an enclosed "bag-like" volume. Sewing front bottom lining to the front portion of inner liner 24 is typically accomplished using a flatbed sewing or post seaming machine capable of sewing through leather. Upper assembly 12 is now in condition to be presented to the last and subsequently lasted.

As is known in the art, lasting involves tightly shaping the upper over the contour of a last, a piece of wood or synthetic material roughly following the shape of the foot and acting as a form on which the shoe is made. In the embodiment of this invention, a last having a McNeil-type hinge is used. This type of last includes a stationary front section hinged together with a movable heel section which swings upward and forward with respect to the front section. In particular, the last is inserted into the front portion of the shoe with the heel section of the last in its open-hinged position. Insole tuck 16 is temporarily tacked to the heel section of the last, the front section of insole tuck 16 overlapping the rear edge of front bottom lining 24. the overlapping edges of the insole tuck and front bottom lining may be adhesively connected. The rear portion of shoe 10 is then pulled over the heel section of the last. Thereafter, the hinge is closed to provide heel-to-toe tension to the shoe.

Figure 3:
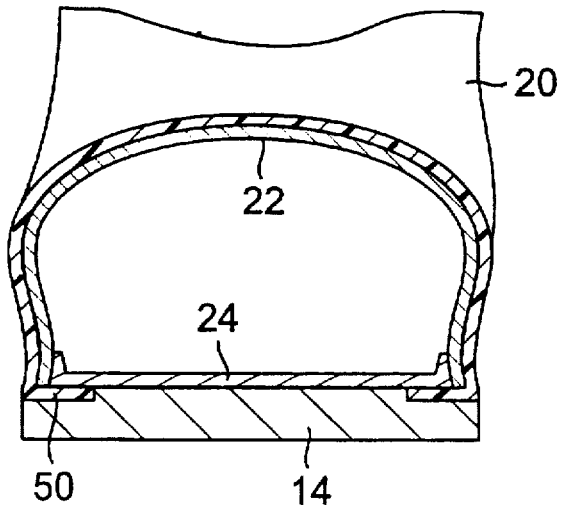
FIG. 3 is a cross-sectional view of the shoe taken along lines 3—3 of FIG. 6.
Figure 4:
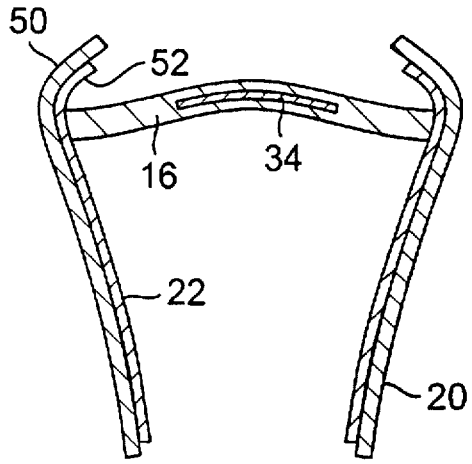
FIG. 4 is a cross-sectional view of the rearward portion of the shoe illustrating a lasting operation taken along lines 4—4 of FIG. 2 (with the insole tuck in place).

Referring to FIGS. 3 and 4, the lasting operation is performed with lasting edges 50, 52 of upper 20 and inner liner 22, respectively, "wiped" in overlying relationship to insole tuck 16 and front bottom lining 24. A conventional adhesive may be used to permanently bond the wiped-over lasting edge 50 to insole tuck and front bottom lining 24. Lasting edge 50 which overlies insole tuck 16 may alternatively be "heel-seat" lasted with tacks or nails.

Figure 5:
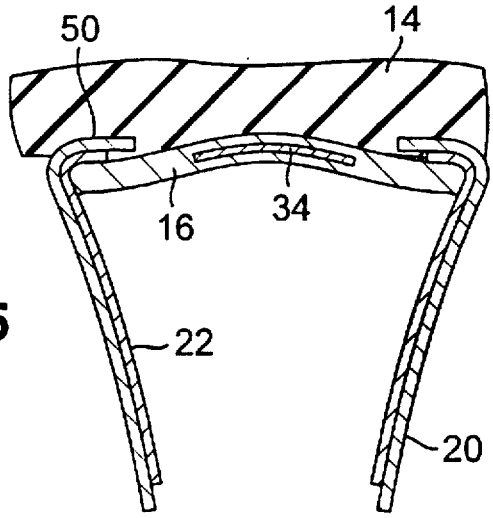
FIG. 5 is a cross-sectional view of the rearward portion of the shoe taken along lines 5—5 of FIG. 6 after lasting and an outsole (without heel) attached thereto.
Figure 6:
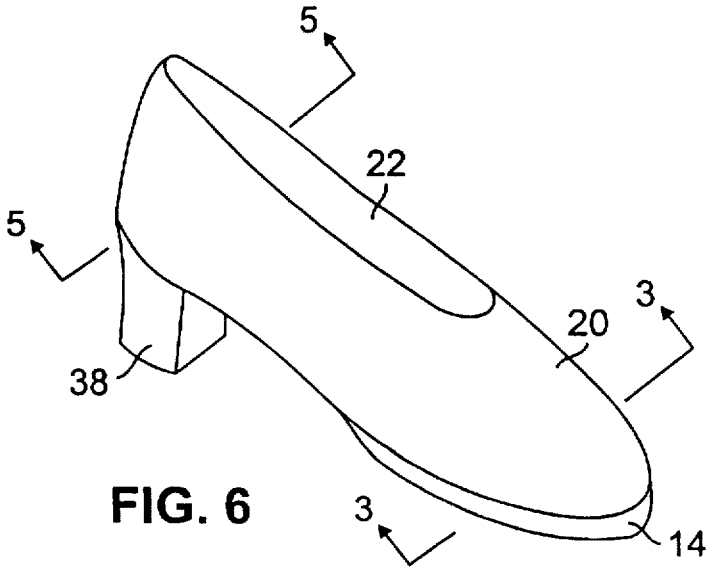
FIG. 6 is a perspective view of the completed shoe of FIG. 1.

Referring to FIG. 5, outsole 14, formed of molded polyurethane is then adhesively bonded to the bottom of the lasted upper assembly 12 and inner liner 22. The last is then removed from the shoe and heel 38 is attached through insole tuck 16 and outsole 14 using fixation members (e.g., rivets, screws) 39 (FIG. 1). Finally, sock liner 18 is inserted into the volume of upper assembly 12 within which the wearer's foot is to be inserted and over insole tuck 16 and front bottom lining 22. Note that a cushioning pad 44 (FIG. 1) of polyurethane foam is typically bonded to the underside of the front portion of sock liner 18 with an adhesive to occupy the space over front bottom lining 24 that is within the internal volume of the completed shoe. The completed shoe 10 is shown in FIG. 6.

Other embodiments are within the following claims. For example, although a last having a McNeil-type hinge was used in constructing the rearward portion of the shoe in the above embodiment, lasts with other hinge arrangements (e.g., telescopic hinges), may alternatively be used.

What is claimed is:

1. A method for construction of footwear comprising the steps of: providing an upper defining a volume for receiving a wearer's foot, the upper having a peripheral lasting edge;

sewing an inner liner to an inner surface of the upper;

sewing a front bottom lining to a peripheral edge of a front portion only of the inner liner;

lasting, along an edge of a last, the peripheral lasting edge portion of the upper over an insole tuck and front bottom lining, the insole tuck being temporarily secured to the last;

securing the outsole over the lasted upper and attaching a heel member to the insole tuck through the outsole.

2. The method of claim 1 further comprising attaching the heel member with fixation members.

3. A method for construction of footwear comprising the steps of:

providing an upper defining a volume for receiving a wearer's foot, the upper having a peripheral lasting edge;

sewing an inner liner to an inner surface of the upper;

sewing a front bottom lining to a peripheral edge of a front portion only of the inner liner;

lasting, along an edge of a last, the peripheral lasting edge portion of the upper over an insole tuck and front bottom lining, the insole tuck being temporarily secured to the last;

securing the outsole over the lasted upper; and attaching a heel member to the insole tuck through the outsole.

4. The method of claim 3 wherein the front bottom lining has a thickness in a range between 0.2 mm and 0.5 mm and the insole tuck has a thickness in a range between 2 mm and 6 mm.

5. The method of claim 3 wherein the front bottom lining is formed of a non-stretchable material.

6. The method of claim 3 further comprising the step of providing a rigid reinforcement shank within the insole tuck prior to the lasting step.

7. The method of claim 3 further comprising the step of attaching a heel to a rearward portion of the outsole.

8. The method of claim 3 further comprising the step of inserting a sock liner within the volume of the upper.

9. The method of claim 3 wherein the insole tuck is formed of a rigid material.

10. The method of claim 3 further comprising attaching the heel member with fixation members.

* * * * *